US007625685B2

(12) United States Patent
Kawata

(10) Patent No.: US 7,625,685 B2
(45) **Date of Patent: *Dec. 1, 2009**

(54) MAGNETIC MONO-COMPONENT TONER FOR DEVELOPING ELECTROSTATIC LATENT IMAGE AND IMAGE FORMING METHOD

(75) Inventor: Hideaki Kawata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/287,402

(22) Filed: Oct. 9, 2008

(65) Prior Publication Data

US 2009/0053643 A1 Feb. 26, 2009

Related U.S. Application Data

(62) Division of application No. 11/234,565, filed on Sep. 23, 2005, now Pat. No. 7,452,648.

(30) Foreign Application Priority Data

Sep. 30, 2004 (JP) ..... 2004-286939

(51) Int. Cl.
*G03G 9/00* (2006.01)

(52) U.S. Cl. ..... 430/110.4; 430/106.1; 430/123.5; 430/124.4; 430/124.51; 399/265; 399/279

(58) Field of Classification Search ..... 430/110.4, 430/106.1, 123.5, 124.4, 124.51; 399/265, 399/279

See application file for complete search history.

(56) References Cited

U.S. PATENT DOCUMENTS

| | | | | |
|---|---|---|---|---|
| 6,649,315 | B1 | 11/2003 | Takasaki | |
| 6,824,942 | B2 | 11/2004 | Silence et al. | |
| 7,452,648 | B2 * | 11/2008 | Kawata | 430/110.4 |

FOREIGN PATENT DOCUMENTS

| | | |
|---|---|---|
| EP | 0 772 092 A1 | 5/1997 |
| JP | 55-018656 | 8/1980 |
| JP | 09-080913 | 3/1997 |
| JP | 2003-162089 | 6/2003 |

* cited by examiner

*Primary Examiner*—Mark A Chapman
(74) *Attorney, Agent, or Firm*—Carmody & Torrance LLP

(57) ABSTRACT

The present invention provides a magnetic mono-component toner which can suppress a selection development on a latent image carrier and can maintain favorable image properties for a long period by using a toner having the coarse powder distribution (S) within a given range in a jumping developing method and an image forming method which uses the toner. In the toner used in the jumping developing method which develops an electrostatic latent image formed on a latent image carrier using a developer carrier, the toner includes toner particles which contain at least a binding resin and a magnetic powder, and the coarse powder distribution (S) of the toner particles satisfies a following formula (1).

$$\text{Coarse powder distribution } (S) = (50 - A)/2 \geqq 17 \quad (1)$$
(volume %/μm)

(wherein, A is a volume % of the coarse powder having particle sizes larger than $D_{50}$ based on volume by 2 μm or more).

6 Claims, 6 Drawing Sheets

MAGNETIC MONO-COMPONENT TONER FOR DEVELOPING ELECTROSTATIC LATENT IMAGE AND IMAGE FORMING METHOD

CROSS REFERENCE TO RELATED APPLICATIONS

This application is a divisional of U.S. application Ser. No. 11/234,565, filed Sep. 23, 2005, now U.S. Pat. No. 7,452,648 the subject matter of which is herein incorporated by reference in its entirety.

BACKGROUND OF THE INVENTION

1. Field of the Invention

The present invention relates to a magnetic mono-component toner for developing an electrostatic latent image (hereinafter simply referred to as "magnetic mono-component toner") and an image forming method which uses the toner.

More particularly, the present invention relates to a magnetic mono-component toner and an image forming method which uses the toner, wherein with the use of the toner having the coarse powder distribution (S) within a given range in an image forming apparatus which adopts a jumping developing method, a selected developing on a latent image carrier is suppressed and hence, favorable image properties are maintained for a long period.

2. Description of the Related Art

In general, in an electrophotographic method, an electrostatic recording method or the like, a latent image carrier formed of a photoconductive photosensitive body or a dielectric is charged by a corona charge or the like, an electrostatic latent image formed by exposure using laser beams, an LED or the like is visualized using a developer such as toner, or the electrostatic latent image is visualized by inversion developing thus obtaining a high quality image.

Usually, as a toner applicable to these developing methods, toner particles which have an average particle size of 5 to 15 μm and are obtained by a following method is used. That is, a dye or a pigment which constitutes a coloring agent or a charge controlling agent, a wax which constitutes a peel-off agent, a magnetic material and the like are mixed to a thermoplastic resin (a binding resin) which constitutes a binder, and the mixture is blended, pulverized and classified to form the above-mentioned toner particles. Further, to impart fluidity to the toner, to perform a change control of the toner and to enhance the cleaning property, an inorganic fine powdery material or an inorganic metal fine powdery material made of silica, titanium oxide or the like is added to the toner. Further, as a developing method, there have been known a di-component developing method which uses toner and a carrier such as iron powder and a magnetic mono-component developing method which contains a magnetic body in the inside of the toner without using carrier.

To be more specific, there have been known a large number of developing methods which adopt a magnetic brush method described in U.S. Pat. No. 2,874,063 (patent document 1), a cascade developing method and a powder cloud method described in U.S. Pat. No. 2,618,552 (patent document 2), and a fur brush developing method. In these methods which use the di-component developer, the methods can provide a relatively stable high-quality image in an initial stage. However, when these methods are used for a long period, the deterioration of the carrier, that is, a spent development arises thus giving rise to drawbacks such as the lowering of the charge imparting ability of the carrier which leads to the difficulty in acquisition of the high-quality image for a long period. Further, these methods have a common defect that it is difficult to maintain a mixing ratio between toner and carrier at a fixed value and hence, the methods lack the durability in a long period.

Accordingly, various developing methods which use a mono-component developer consisting of only toner have been proposed and, particularly, a magnetic mono-component developing method which adopts the magnetic toner is used in general (see U.S. Pat. No. 3,909,258 (patent document 3), JP55-18656 A (patent document 4), JP2003-162089A (patent document 5).

SUMMARY OF THE INVENTION

However, these developing methods have following drawbacks. That is, in the patent document 3 discloses the method in which a conductive magnetic toner is held on a conductive developer carrier which contains a magnetic body therein and developing is performed by bringing the toner into contact with an electrostatic latent image. However, the toner used in the method is conductive and hence, there exists the drawback that when the toner image on the latent image carrier is transferred to a printing paper, it is difficult to perform the transfer electrostatically by making use of an electric field.

Further, because of undesirable phenomena attributed to the conductive toner used in respective steps, there exist the drawback that it is difficult to obtain the high image quality for a long period and the drawback that a breakdown arises due to electric leaking to the latent image carrier.

Further, the method which is disclosed in the patent document 4 can solve the drawback that the di-component developer lacks the long-term durability with the use of the developing method which uses the magnetic mono-component jumping method. However, the method cannot sufficiently cope with the change of image properties and durability along with a demand for high-speed printing.

Further, the patent document 5 discloses a method for controlling a charge quantity of toner, wherein a magnetic toner has a weight average particle size within a specified range. However, the toner requires a control of the circularity of the toner and the use of a specific magnetic powder as prerequisites and hence, there arises a drawback that the productivity is lowered. Further, the method is requested to seek for the higher durability and higher image quality.

Further, as a fundamental drawback of the developing method of the magnetic mono-component jumping system, there exists a phenomenon which is referred to as "selection development". The selection development is a phenomenon in which the toner is developed with an electric force so that, provided that electric fields which act on respective toners are equal, the toners are selectively transferred to a latent image carrier in descending order of friction charging quantity. Although the carrier which charges the toner is present in the di-component developing method, in the mono-component developing method, such carrier which charges the toner is not present and hence, such a development occurs in an apparent manner. Further, there exists the correlation between the charge quantity and the particle size of toners, wherein the larger the particle size, that is, the larger the weight of the toners, the charge quantity becomes smaller, while the smaller the particle size, the charge quantity becomes larger.

Accordingly, each time the developing is repeated, there arises a drawback that the toners having larger sizes are left in the inside of a developing unit. When such a selection development occurs, the image after a durable period exhibits the image density which is lower than the image density in an initial stage thus producing a fogged image (overlapped image).

Accordingly, inventors of the present invention have extensively studied these drawbacks of the related art and have found that with the use of a magnetic mono-component toner having the coarse powder distribution (S) within a given range in a jumping developing method, it is possible to suppress a selection development by controlling a content of the coarse powder which falls out of a proper charge region and hence, it is possible to maintain the favorable image characteristics for a long period.

That is, it is an object of the present invention to provide a magnetic mono-component toner and an image forming method which uses the toner, wherein even when image forming is repeatedly performed, by controlling a coarse powder quantity of a toner in a developing step within a given range, the particle size distribution of the toner on a latent image carrier can be made uniform and hence, image characteristics may be maintained for a long period.

According to one aspect of the present invention, there is provided an electrostatic latent image magnetic mono-component toner used in a jumping developing method which develops an electrostatic latent image formed on a latent image carrier using a developer carrier, wherein the toner includes toner particles which contain at least a binding resin and a magnetic powder, and the coarse powder distribution (S) of the toner particles satisfies a following formula (1), $$\text{Coarse powder distribution } (S)=(50-A)/2 \geqq 17 \text{ (volume \%/μm)} \quad (1)$$

(wherein, A: volume % of coarse powdery material having particle size larger than $D_{50}$ based on volume by 2 μm)

That is, with the use of the toner having the coarse powder distribution which falls within the given range, it is possible to control a content of the coarse powder which falls outside the proper discharge region and hence, the selection development may be suppressed whereby the favorable image characteristics may be maintained for a long period.

Further, in forming the electrostatic latent image developing magnetic mono-component toner of the present invention, it is desirable that the coarse powder distribution (S) is a value which falls within a range of 18 to 24 volume %/μm.

Due to such formation of the toner, even when the toner particles which contain a given quantity of coarse powder are used, it is possible to maintain the desired image characteristics.

Further, in forming the electrostatic latent image developing magnetic mono-component toner of the present invention, it is desirable that the $D_{50}$ based on volume is a value which falls within a range of 5 to 10 μm.

Due to such formation of the toner, it is possible to control the particle size distribution of the whole toner particles and hence, the toner can contain the fine powder quantity and the coarse powder quantity in a well-balanced manner.

Further, in forming the electrostatic latent image developing magnetic mono-component toner of the present invention, it is desirable that assuming the $D_{50}$ based on volume before printing with the toner particles as $D_1$ and the $D_{50}$ based on volume after printing 150,000 sheets of A4 size paper with the toner particles as $D_2$, a value expressed by $(D_2-D_1)$ is set to 1.0 μm or less.

Due to such formation of the toner, it is possible to control the particle size distribution of the toner particles and it is also possible to use the value of $D_{50}$ based on volume as a standard to prevent the selection development.

Further, in forming the electrostatic latent image developing magnetic mono-component toner of the present invention, it is desirable that a ten-point average roughness (Rz) of a surface of a sleeve of the developer carrier falls within a range of 2 to 8 μm.

Due to such formation of the toner, it is possible to form and maintain a uniform thin top layer on the developing sleeve irrespective of a change with respect of lapse of time or a change of an environment.

Further, in forming the electrostatic latent image developing magnetic mono-component toner of the present invention, it is desirable that the toner particles contain toner particles having a particle size of 4.0 μm or less and a cumulative number of 30 number % or less.

Due to such formation of the toner, it is possible to control the fine powder quantity within a given range and hence, it is possible to effectively suppress the selection development.

Further, in forming the electrostatic latent image developing magnetic mono-component toner of the present invention, it is desirable that an average circularity of the toner particles is a value which falls within a range of 0.92 to 0.96.

Due to such formation of the toner, the toner can obtain the fluidity and, at the same time, the charge adjustment may be easily performed.

Further, in forming the electrostatic latent image magnetic mono-component toner of the present invention, it is desirable that the latent image carrier is an amorphous silicon photosensitive body and Vickers hardness of an outermost surface of the amorphous silicon photosensitive body is 300 or less.

Due to such formation of the toner, it is possible to accurately determine the toner adhesion quantity on the latent image carrier and hence, it is possible to maintain the image quality in the stable manner.

Further, according to another aspect of the present invention, there is provided an image forming method in which any one of the above-mentioned electrostatic latent image developing magnetic mono-component toners is applied to an image forming device provided with a jumping developing method.

That is, by applying the toner which sets the coarse powder distribution thereof within a given range to a specific image forming device, the selection development on the later image carrier may be suppressed thus capable of obtaining an image quality which is stable for a long period.

DESCRIPTION OF THE PREFERRED EMBODIMENTS

First Embodiment

Figure 1:
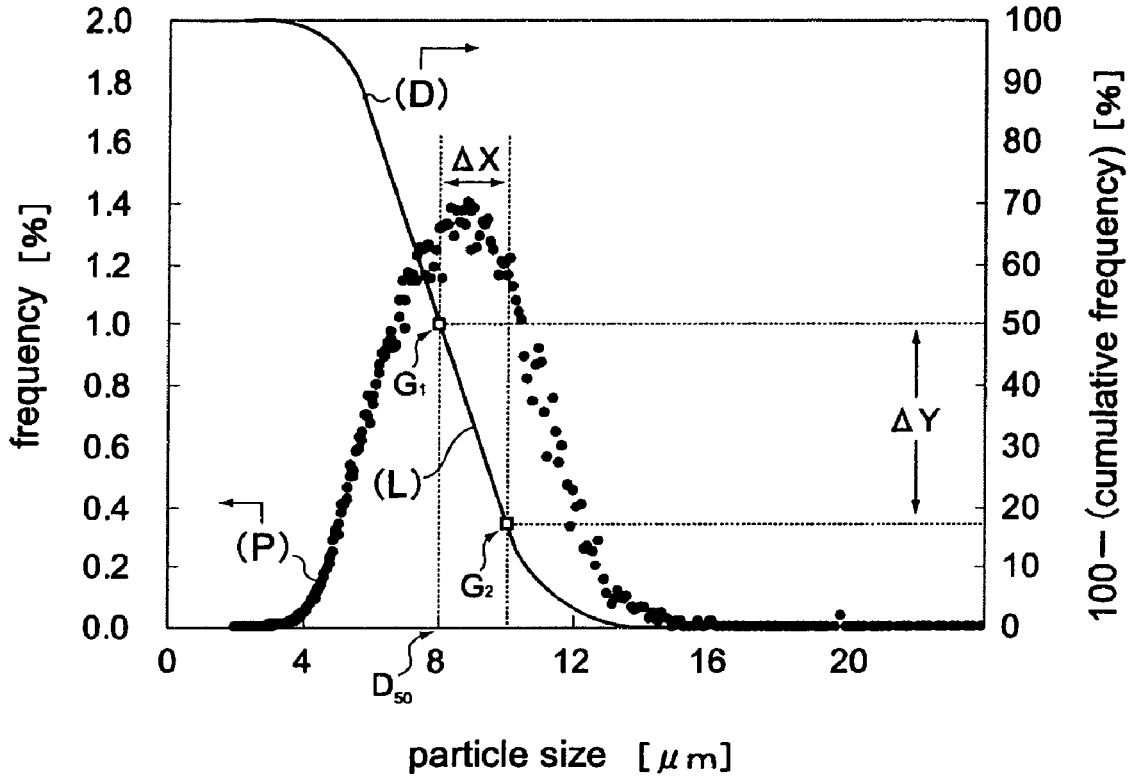
FIG. 1 is a characteristic diagram showing the particle size distribution and a cumulative frequency curve.

The first embodiment of the present invention is directed to a magnetic mono-component toner used in a jumping developing method which develops an electrostatic latent image formed on a latent image carrier using a developer carrier, wherein the toner includes toner particles which contain at least a binding resin and a magnetic powder, and the coarse powder distribution (S) of the toner particles satisfies the above-mentioned formula (1).

(1) Magnetic Mono-Component Toner

The magnetic mono-component toner includes toner particles which contain at least a binding resin and a magnetic powder, wherein the toner is allowed to contain various kinds of additives such as a wax, a coloring agent, a charge controller and the like depending on a usage mode of the toner.

(1)-1 Binding Resin (1)-1-1 Kind

Although a kind of the binding resin used in the toner of the present invention is not particularly limited and, as the binding resin, it is preferable to use a thermoplastic resin such as, for example, a styrene resin, an acrylic resin, styrene-acrylic copolymer, a polyethylene resin, a polypropylene resin, a vinyl chloride resin, a polyester resin, a polyamide resin, a polyurethane resin, a polyvinyl alcohol resin, a vinyl ether resin, a N-vinyl resin, a styrene-butadiene resin etc.

To be more specific, as the polystyrene resin, either a polymer of styrene or a copolymer with other copolymerized monomers which can be copolymerized with styrene may be used.

As the copolymerization monomers, p-chloro styrene; vinyl naphthalene; ethylene unsaturated monoolefin such as ethylene, propylene, butylene, isobutylene; vinyl halide such as vinyl chloride, vinyl bromide, vinyl fluoride; vinyl esters such as vinyl acetate, vinyl propionate, vinyl benzoate, vinyl butyrate; (metha) acrylic ester such as methyl acrylate, ethyl acrylate, n-butyl acrylate, isobutyl acrylate, dodecyl acrylate, n-octyil acrylate, 2-chloroethyl acrylate, phenyl acrylate, α-chloro methyl acrylate, methyl methacrylate, ethyl methacrylate, butyl methacrylate; acrylic acid derivative such as acrylonitrile, methacrylonitrile, acrylamide; vinyl ethers such as vinyl methyl ether, vinyl isobutyl ether; vinyl ketone such as vinyl methyl ketone, vinyl ethyl ketone, methyl isopropenyl ketone; N-vinyl compound such as N-vinyl pyrrole, N-vinyl carbazole, N-vinyl indols, N-vinyl pyrrolidone and the like are named. With respect to these copolymerization monomers, one copolymerization monomer may be used in a single form or two or more copolymerization monomers may be combined and copolymerized with a styrene monomer.

Further, as the polyester resin, any resins may be used provided that the resin is obtained by the condensation polymerization or the co-condensation polymerization of the alcohol component and the carbonic acid component.

As components which are used for synthesizing the polyester resin, followings are named.

First of all, as the alcohol components having two or three or more valences, diol such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol; bisphenol such as bisphenol A, hydrogenated bisphenol A, polyoxyethylene-modified bisphenol A, polyoxypropylene-modified bisphenol A; and alcohol having three or more valences such as sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, diglycerol, 2-methylpropanetriol, 2-methyl-1,2,4-butanetriol, trimethylol ethane, trimethylol propane, 1,3,5-trihydroxymethylbenzene are exemplified.

As the carboxylic acid components having two or three or more valences, divalent and trivalent carboxylic acid, and acid anhydride or lower alkyl esters thereof are used. Here, as the divalent carboxylic acids, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-butyl succinic acid, n-butenyl succinic acid, isobutyl succinic acid, isobutenyl succinic acid, n-octyil succinic acid, n-octenyl succinic acid, n-dodecyl succinic acid, n-dodecenyl succinic acid, isododecyl succinic acid, isododecenyl succinic acid, alkyl or alkenyl succinic acid, are exemplified, while as the trivalent or more carboxylic acids, 1,2,4-benzenetricarboxylic acid(trimellitic acid) 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, enpoltrimeric acid are exemplified.

Further, it is preferable that a softening point of the polyester resin is set to 80 to 150° C. and it is more preferable that the softening point of the polyester resin is set to 90 to 140° C.

Further, the binding resin may be the thermosetting resin. By partially introducing the bridge cross-linking structure in the toner in this manner, it is possible to enhance the preservation stability or the shape holding property or the durability of the toner. Accordingly, as the binding resin of the toner, it is unnecessary to use the thermoplastic resin by 100 parts by weight and it is preferable to partially add a cross-linking agent or use the thermosetting region partially.

Accordingly, as the thermosetting resin, an epoxy resin, a cyanate resin may be used. To be more specific, one kind of or the combination of two or more kinds of resins selected from a group consisting of a bisphenol-A type epoxy resin, a hydrogenated bisphenol A-type epoxy resin, a novolac-type epoxy resin, a polyalkylene ether-type epoxy resin, a cyclic aliphatic-type epoxy resin, a cyanate resin may be named.

(1)-1-2 Glass Transition Point

Further, in this invention, it is desirable that the glass transition point (Tg) of the binding resin falls within a range of 50 to 65° C. and it is more desirable that the glass transition point (Tg) of the binding resin falls within a range of 50 to 60° C.

When the glass transition point is lower than the above-mentioned range, the obtained toners are fused to each other in a developing unit thus lowering the preservation stability. Further, since a strength of the resin is low, the toner is liable to be adhered to the photosensitive body. On the other hand, when the glass transition point is higher than the above-mentioned range, the low-temperature fixing property of the toner is lowered.

Here, the glass transition point of the binding resin may be obtained based on a change point of specific heat using a differential scanning calorimeter(DSC). To be more specific, it is possible to obtain the glass transition point by measuring a heat absorption curve using a differential scanning calorimeter DSC-6200 made by Seiko Instruments Corp as a measuring device. To be more specific, 10 mg of a measuring sample is put into an aluminum pan, an empty aluminum pan is used as a reference, and the measurement is performed at a measuring temperature range of 25 to 200° C. and an elevation speed 10° C./min under normal temperature and normal moisture, and the glass transition point may be obtained based on the obtained heat absorption curve.

(1)-2 Magnetic Powder

The magnetic mono-component toner of the present invention contains a magnetic powder in the binding resin. As such a magnetic powder, a known material such as a metal which exhibits strong magnetism such as iron including ferrite and magnetite, cobalt, nickel, an alloy, a compound which contains the metal or the alloy, an alloy which does not contain a strong magnetism element but exhibits the strong magnetism by receiving the proper heat treatment, a chromium dioxide and the like may be named.

These magnetic powders are uniformly dispersed in the above-mentioned binding resin in a form of fine powder with an average particle size which falls within a range of 0.1 to 1.0 μm, and more particularly within a range of 0.1 to 0.5 μm. Further, it is possible to use the magnetic powders after applying the surface treatment to the magnetic powder using a titanium-based coupling agent, a silane-based coupling agent.

Further, it is desirable that the toner contains 30 to 60 parts by weight of the magnetic powder, and it is more desirable that the toner contains 40 to 50 parts by weight of the magnetic powder. When an amount of the magnetic powder exceeds the above-mentioned range, the durability of the image density is deteriorated and the fixing property is liable to be remarkably lowered, while when the amount of the magnetic powder is below the above-mentioned range, fogging is increased with respect to the durability of image density.

(1)-3 Wax

Although the wax which is used for enhancing the fixing property or the prevention of the offset property is not particularly limited, it is preferable to use, for example, a polyethylene wax, a polypropylene wax, a fluororesin wax, a fischer-tropsch wax, a paraffin wax, an ester wax, a montan wax, a rice wax and the like. Further, two or more of these waxes may be used at a time. By adding these waxes, the prevention of the offset property may be enhanced while effectively preventing the smearing of image (smear in a periphery of an image when the image is abraded).

Further, with respect to an addition quantity of a wax, it is desirable that 1 to 5 parts by weight of the wax is blended in the toner (assuming a total toner quantity as 100 parts by weight). When the addition quantity of the wax is less than 1 part by weight, there exists a tendency that the prevention of the offset property may not be enhanced and the image smearing or the like may not be efficiently prevented. On the other hand, when the addition quantity of the wax exceeds 5 parts by weight, there exists a tendency that the toners are melted to each other and hence, the preservation stability is lowered.

(1)-4 Coloring Agent

In the toner of the present invention, for adjusting a tone of the toner, a pigment such as carbon black or a dye such as acid violet may be dispersed in the binding resin as a coloring agent.

Usually, the coloring agent is blended to the toner at a rate of 1 to 10 parts by weight of coloring agent relative to 100 parts by weight of the above-mentioned binding resin.

(1)-5 Charge Controlling Agent

Further, the charge controlling agent used in the present invention is blended in the toner for remarkably enhancing a charge level or the charge rise characteristic (an index to indicate whether toner is charged to a fixed level in a short time), thus providing the excellent durability and stability. That is, when the toner is served for development in a positively charged state, a positively charged charge controlling agent is added, while when the toner is served for development in a negatively charged state, a negatively charging controlling agent is added.

(1)-5-1 Positively Charging Controlling Agent

As specific examples of the positively charging controlling agent, azine compound such as pyridazine, pyrimidine, pyradine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinozolin, quinoxaline; a direct dyes made of azine compounds such as azine fast red FC, azine fast red 12BK, azine violet BO, azine brown 3G, azine light brown GR, azine dark green BH/C, azine deep black EW and azine deep black 3RL; nigrosine compounds such as nigrosine, nigrosine salt, nigrosine derivative; acidic dyes of nigrosine compounds such as nigrosine BK, nigrosine NB, nigrosine Z; metallic salts of naphthenate or of higher fatty acid; quaternary ammonium salts of alkoxylated amine; alkylamide; benzylmethylhexyldecyl ammonium; and decyltrimethyl ammonium chloride.

These compounds may be used in one kind or in two or more kinds in combination.

Particularly, nigrosine compound is optimum as the positively charged toner from a viewpoint that the nigrosine compound can obtain the faster rise characteristics.

Further, a resin or an oligomer and the like having quaternary ammonium salt, carboxylic acid salt or carboxyl group as functional groups may be also used as a positively charged charging controlling agent.

To be more specific, one or two or more kinds of styrene resin having quaternary ammonium salt, an acrylic resin having quaternary ammonium salt, a styrene-acrylic resin having quaternary ammonium salt, a polyester resin having quaternary ammonium salt, a styrene resin having carboxylic acid salt, an acrylic resin having carboxylic acid salt, a styrene-acrylic resin having carboxylic acid salt, a polyester resin having carboxylic acid salt, a polystyrene resin having carboxyl group, an acrylic resin having carboxyl group, a styrene-acrylic resin having carboxyl group, a polyester resin having carboxyl group may be named.

Particularly, a styrene-acrylic copolymer resin having the quaternary ammonium salt as a functional group is optimum from a viewpoint that a charge quantity may be easily adjusted within a desired range.

In this case, as an acrylic comonomer which is copolymerized with the styrene unit, (meth)acrylic acid alkylesters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl metacrylate, iso-butyl metacrylate may be named.

Further, as the quaternary ammonium salt, a unit which is derived from dialkyl aminoalkyl (meth)acrylate through the step for quaternary operation may be used. As the derived dialkyl aminoalkyl (meth)acrylates, for example, di(lower-alkyl)aminoethyl (meth)acrylates such as dimethyl aminoethyl (meth)acrylate, diethyl aminoethyl (meth)acrylate, dipropyl aminoethyl (meth)acrylate, dibutyl aminoethyl (meth) acrylate; dimethyl methacrylamide, dimethyl aminopropyl methacrylamide may be preferably used. Further, hydroxy-group-containing polymerizable monomers such as hydroxyethyl (meth)acrylate, hydroxypropyl (meth)acrylate, 2-hydroxybutyl (meth)acrylate, N-methylol (meth) acrylamide may be used in combination at the time of polymerization.

(1)-5-2 Negatively Charging Controlling Agent

As the negatively charging controlling agent which exhibits the negatively charged property, for example, organometallic complex and chelate compound may be effectively used. As an example of the negatively charging controlling agent, aluminum acetylacetonate, iron(II) acetylacetonate, 3,5-di-tert-buthyl salicylic acid chromium or the like are named. Particularly, acetylacetonate metallic complex or salicylic acid metallic complex or salt may be preferably used. It is further preferable to use salicylic acid metallic complex or salicylic acid metallic salt.

(1)-5-3 Addition Quantity

With respect to the above-mentioned positively charged or negatively charging controlling agent, it is desirable that 1.5 to 15 parts by weight, preferably 2.0 to 8.0 parts by weight, and more preferably 3.0 to 7.0 parts by weight of the charge controlling agent is generally included in the toner (assuming a total toner quantity as 100 parts by weight).

The reason is that when the addition quantity of the charge controlling agent is smaller than the above-mentioned range, the stable charging of the toner to the desired polarity is liable to become difficult. Further, in forming the image by developing an electrostatic latent image using the toner, the image density is liable to be lowered or the durability of the image density is liable to be lowered. Further, the toner easily suffers from the insufficient dispersion of the charge controlling agent thus giving rise to so-called fogging and the acceleration of the contamination of the photosensitive body.

On the other hand, when the addition quantity of the charge controlling agent is larger than the above-mentioned range, the environment resistance property is deteriorated, and more particularly, the defective charge and the defective image under high temperature and high humidity are liable to occur easily thus leading to the drawbacks such as the contamination of the photosensitive body and the like.

(1)-6 Additive Agent

Further, in the toner of the present invention, as additive agents, for example, fine particles (usually having an average particle size of 1.0 μm or less) made of colloidal silica, hydrophobic silica, alumina, titanium oxide may be added.

The additive agent is employed for enhancing the fluidity, the preservation and stability property, the cleaning property and the like by applying the surface treatment to the toner and 0.2 to 10.0 parts by weight of the additive agent is used with respect to the total toner quantity. Although the addition of the fine particles is performed by agitating and mixing the magnetic toner in a dry method, it is desirable to perform the agitation and mixing using a Henschel mixer, a Nauta mixer or the like to prevent the additive agent from being embedded into the toner.

(2) Coarse Powder Distribution (2)-1 Formula (1)

Further, the toner of the present invention is characterized in that the coarse powder distribution (S) of the toner satisfies the above-mentioned formula (1). Here, the coarse powder distribution (S) is defined as a ratio between a change quantity of a particle size of the toner particles and a change quantity of cumulative frequency with respect to the change quantity of a particle size of the toner particles To be more specific, as shown in FIG. 1. in a characteristic diagram including the particle size distribution (P) and a cumulative frequency curve (D) which is obtained by accumulating the particle size distribution (P) from the coarse powder side, the coarse powder distribution (S) is defined as a rate ($\Delta X/\Delta Y$) of the change quantity $\Delta Y$ (volume %) of the cumulative frequency relative to change quantity $\Delta X$ (μm) of the particle size. Here, the change quantities $\Delta X$ and $\Delta Y$ are obtained as positive values.

That is, the coarse powder distribution (S) is generally expressed by a following formula (2) as an gradient quantity of a line segment (L) which connects an arbitrary point $G_1$ $(X_1, Y_1)$ and an arbitrary point $G_2$ $(X_2, Y_2)$ on the cumulative frequency curve (D).

Here, the cumulative frequency curve (D) used in this specification is, as mentioned above, the curve obtained by accumulating the particle sizes from the coarse powder side, wherein with respect to the relationship between the generally used so-called cumulative frequency (cumulative frequency obtained by accumulating the particle size from the coarse powder side), there exists the relationship (D)=100−(cumulative frequency) (%).

Further, the particle size of the toner particles shown in FIG. 1 may be measured using a particle size measuring device (Coulter counter-TA-II type made by Coulter Counter Corp), wherein the measurement is performed using an aperture diameter of 100 μm.

$$\text{Coarse powder distribution } (S) = \Delta Y/\Delta X = Y_1 - Y_2/X_2 - X_1 \quad [\text{volume } \%/\mu\text{m}] \tag{2}$$

In defining the coarse powder distribution (S) in this manner, the above-mentioned formula (1) is understood as a case in which, in the above formula (2), the point $G_1$ $(X_1, Y_1)$ is set as $(D_{50}, 50)$ and the point $G_2$ $(X_2, Y_2)$ as $(D_{50}+2, A)$. Here, symbol A expresses the volume % of the coarse powder which is larger than $D_{50}$ based on volume by 2 μm or more.

Further, in the present invention, the present invention is characterized in that the coarse powder distribution (S) in the formula (1) is set to a value equal to or more than 17. The reason is that this value can efficiently control a content of the coarse powder which does not fall within a proper charge region and, as a result, it is possible to maintain the image property for a long time.

On the other hand, when the coarse powder distribution (S) is set to a value below 17, the particles on the coarse powder side which does not reach the proper charged region are not developed in the developing step and hence, there exists a possibility that the particles stay in the inside of the developing unit. Accordingly, there arises a drawback that the insufficiently charged toners are increased and the image density is lowered along with the repetition of printing. Further, the insufficient dispersion of the charge controlling agent is liable to easily occur and hence, the so-called fogging may occur or the photosensitive body may be contaminated.

Figure 2:
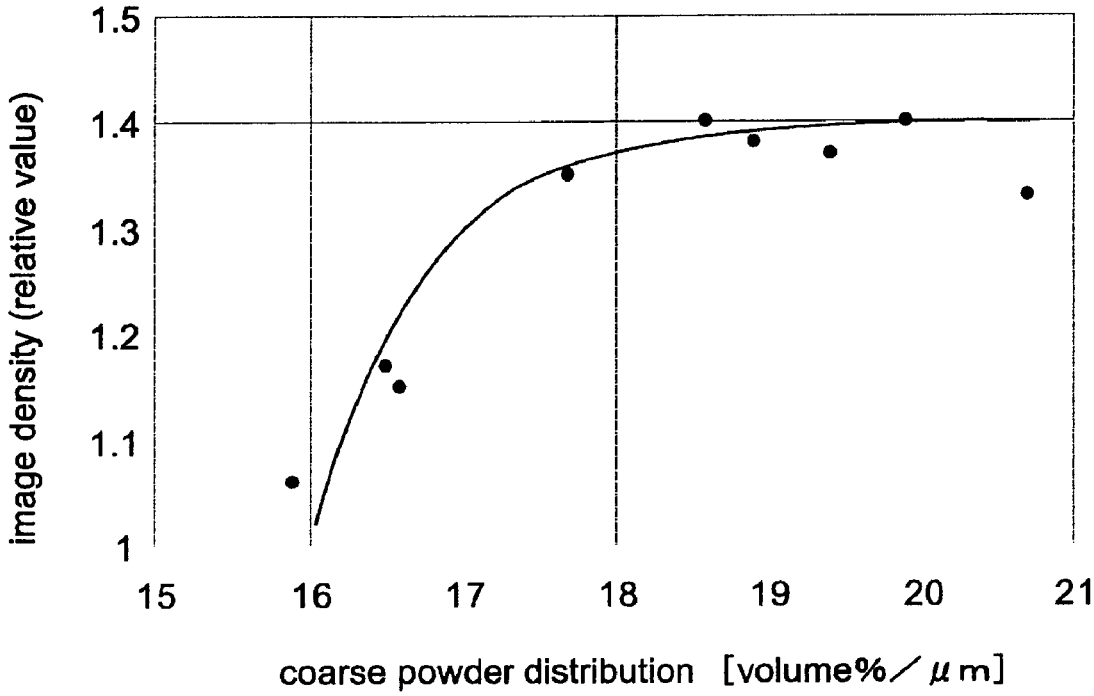
FIG. 2 is a characteristic diagram showing the relationship between the coarse powder distribution and the concentration of an image.

Here, FIG. 2 shows a characteristic graph which evaluates the solid image density with respect to the toner particles which differ in the coarse powder distribution (S) from each other after 150,000 sheets of A4-side paper are continuously printed. As can be understood from such a characteristic graph, when the coarse powder distribution (S) is equal to or more than 17, the image density is maintained at a high value, while when the coarse powder distribution (S) is less than 17, the lowering of the image density becomes apparent.

Further, it is preferable that the coarse powder distribution (S) assumes a value which falls within a range of 18 to 24, and it is more preferable that the coarse powder distribution (S) assumes a value which falls within a range of 19 to 21. By determining the coarse powder distribution (S) in this manner, even when the toner particles which contain a given quantity of coarse powders is used, the fluidity of the toners is maintained whereby the lowering of image density at an initial stage due to the irregularities of the charging property may be prevented.

Figure 3:
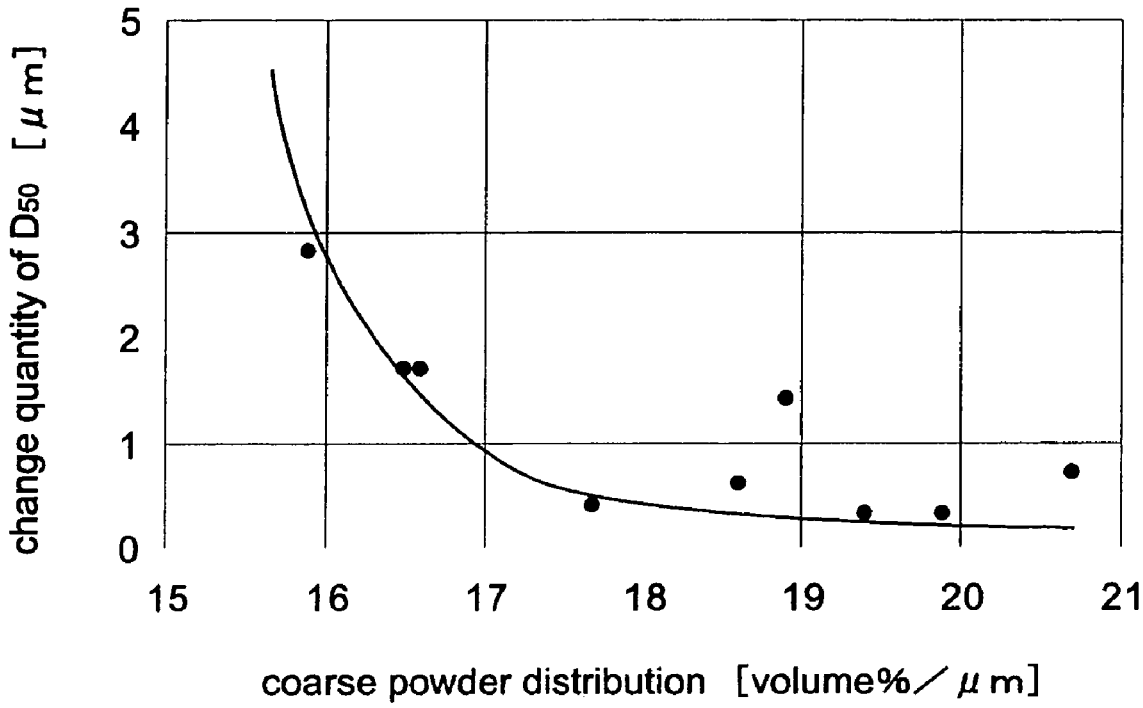
FIG. 3 is a characteristic diagram showing the relationship between the coarse powder distribution and the $D_{50}$ based on volume.

Further, FIG. 3 shows a characteristic graph which evaluates a value expressed by ($D_2$–$D_1$) ($D_{50}$ change quantity based on volume) when $D_{50}$ based on volume of the toner particles before printing is assumed as $D_1$ and $D_{50}$ based on volume of the toner particles after printing 150,000 sheets of A4-size paper as $D_2$ with respect to the toner particles which differ in coarse powder distribution (S) from each other.

Here, as can be understood from the characteristic graph, when the coarse powder distribution (S) is equal to or more than 17, the $D_{50}$ change quantity based on volume is small and hence, the initial particle size distribution is maintained even after printing 150,000 sheets of A4-size paper. On the other hand, it is understood that when the coarse powder distribution (S) is less than 17, the $D_{50}$ change quantity based on volume is large and hence, the coarse powder quantity is increased. That is, by setting the coarse powder distribution (S) to the value equal to or more than 17, even when the printing is repeated, the particle size distribution is maintained and the image characteristics are maintained for a long period. Accordingly, it is preferable to set the coarse powder distribution (S) to the value which falls within a range of 18 to 24, and it is more preferable to set the coarse powder distribution (S) to the value which falls within a range of 19 to 21.

Figure 4:
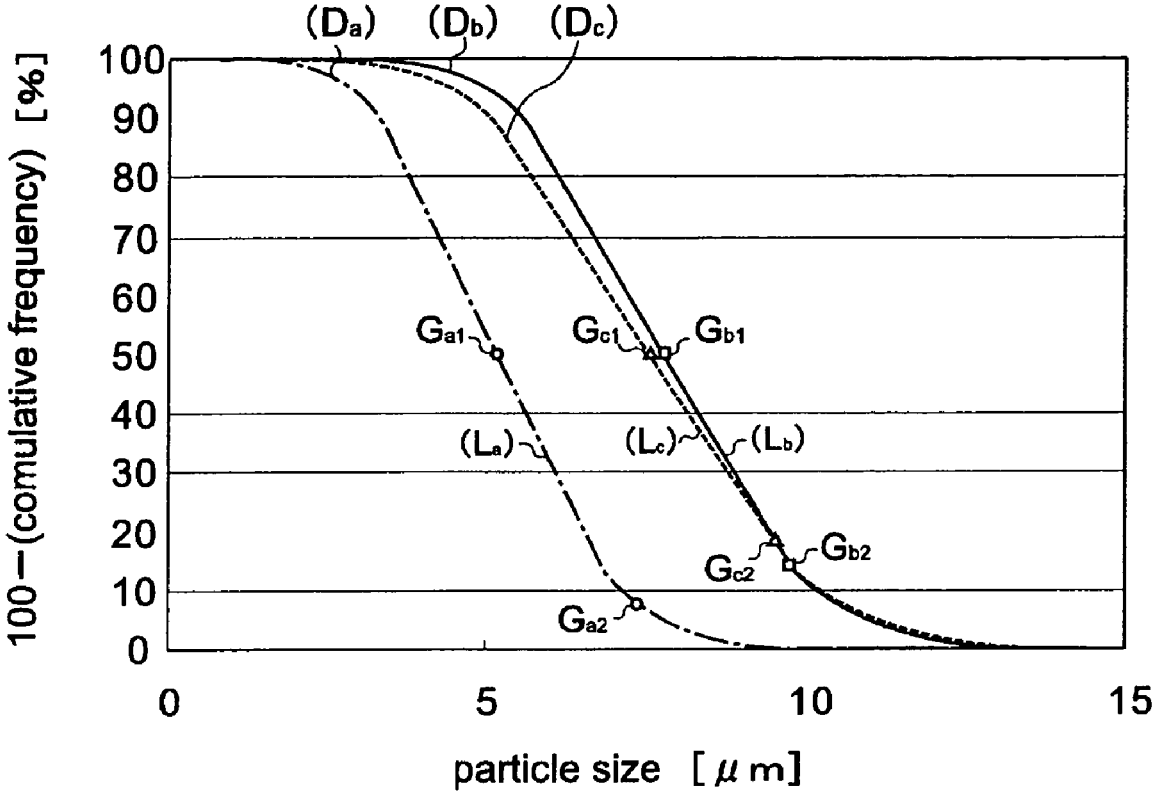
FIG. 4 is a characteristic diagram showing the relationship between the coarse powder distribution and the cumulative frequency curve.

Further, FIG. 4 shows a characteristic graph indicating cumulative frequency curves ($D_a$) to ($D_c$) which differ in coarse powder distribution (S) among the above mentioned toner particles. These ($D_a$) to ($D_c$) indicate the cumulative frequency curves where the value of the coarse powder distribution (S) assumes 20.7, 17.7, 15.9. That is, among the cumulative frequency curves which are shown in the graph, ($D_a$) and ($D_b$) are qualified as the cumulative frequency curves which satisfy the range of coarse powder distribution of the present invention.

Further, points ($G_{a1}$ to $G_{c1}$) which are indicated on the cumulative frequency curves ($D_a$) to ($D_c$) correspond to cumulative frequencies 50%, that is, $D_{50}$ in the respective curves, while points ($G_{a2}$) to ($G_{c2}$) correspond to particle sizes larger than $D_{50}$ by 2 μm.

That is, gradient amounts of straight lines ($L_a$) to ($L_c$) which connect the points ($G_{a1}$) to ($G_{c1}$) and the points ($G_{a2}$) to ($G_{c2}$) indicate the coarse powder distributions (S) which correspond to the respective cumulative frequency curves.

(2)-2 $D_{50}$ Based on Volume

Further, in FIG. 4, it is preferable to set a range of $D_{50}$ based on volume to 5 to 10 μm.

Here, $D_x$ based on volume implies a particle diameter when the frequencies of particle sizes are accumulated in ascending order from particles having a small diameter and an accumulated value reaches X(%) of the whole toner particles. That is, $D_{50}$ based on volume is a volume average particle size. By setting such volume average particle size to a value which falls within a given range, it is possible to control the particle size distribution of the whole toner particles and, hence, the toner can contain the fine powder quantity and the coarse powder quantity in a well-balanced state. Accordingly, it is preferable to set $D_{50}$ based on volume to the value which falls within the range of 5 to 10 μm and it is more preferable to set $D_{50}$ based on volume to the value which falls within the range of 7 to 9 μm.

(2)-3 Fine Power Quantity

Further, it is preferable that toner contains toner particle having a particle size equal to or less than 4.0 μm and a cumulative number of 30 number % or less.

Due to such a constitution, it is possible to determine the fine power quantity in the toner particles within the given range and hence, it is possible to effectively suppress the selection development. That is, it is preferable to set the cumulative number to 30 number % or less and it is more preferable to set the range of the cumulative number to 10 to 25 number %.

(2)-4 Average Circularity

Further, it is preferable that the toner of the present invention assumes the average circularity of 0.92 to 0.96. The reason is that when the average circularity is less than 0.92 the fluidity is deteriorated and the transfer efficiency is lowered, and the image density is liable to be lowered, while when the average circularity exceeds 0.96, although the fluidity and the transfer efficiency are improved and the image density may be easily maintained, the charging control becomes difficult. Here, the average circularity may be obtained using, for example, a flow-type particle image analyzer (FPIA-1000 type made by Sysmex Corp).

(3) Latent Image Carrier (3)-1 Basic Constitution

Figure 5:
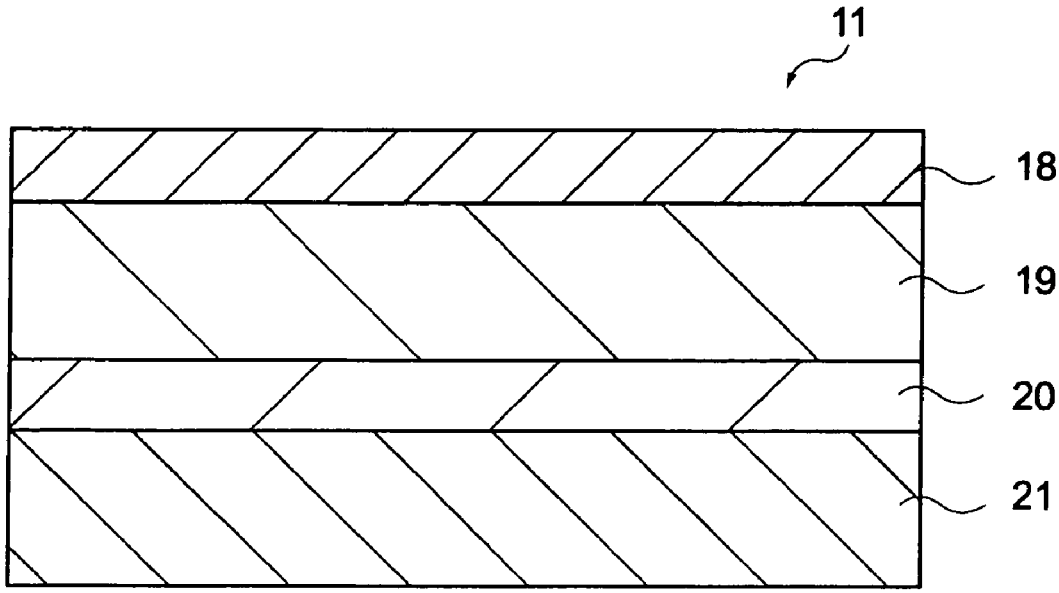
FIG. 5 is a cross-sectional view showing the stacked structure of a latent image carrier.

FIG. 5 is an enlarged cross-sectional view showing a portion of a photosensitive body drum 11 which constitutes the latent image carrier of the present invention. As shown in FIG. 5, as the photosensitive body drum 11, it is preferable to use a stacked-type photosensitive body which is constituted by stacking a carrier interruption layer 20, a photosensitive layer 19 and a surface protective layer 18 on a conductive base body 21.

Further, a film thickness of the photosensitive body drum 11 is equal to or less than 30 μm and preferably is set to a value which falls within a range of 10 to 30 μm. Here, the film thickness of the photosensitive body drum 11 of the present invention implies a film thickness from a surface of the conductive base body 21 which constitutes a base member to a surface of the photosensitive body drum 11, that is, a total thickness of the carrier interruption layer 20, the photosensitive layer 19 and the surface protective layer 18.

The reason is that when the film thickness of the photosensitive body drum 11 exceeds 30 μm, a moving speed of a heat carrier is increased and hence, the dark decay characteristics (charge holding ability of the photosensitive layer in dark place per hour) are lowered and, eventually, the flow of a latent image in the rotating direction of the photosensitive body is liable to occur on a surface of the photosensitive body thus lowering the resolution.

Further, with respect to the relationship with the kinds of the photosensitive bodies, it is known that, not only with respect to an a-Si photosensitive body, but also with respect to an organic photosensitive body (OPC), the smaller the film thickness of the photosensitive body, the resolution is enhanced. Further, also with respect to a cost, the larger the film thickness of the photosensitive body, a film forming time is prolonged and hence, the probability that foreign substances adhere to the photosensitive body is increased whereby a manufacturing yield is lowered. Accordingly, the smaller the total film thickness of the photosensitive body, the cost is reduced and the quality is also enhanced.

On the other hand, when the film thickness of the photosensitive body drum 11 is less than 10 μm, the charging ability which the photosensitive body posses is lowered and hence, there exists a possibility that a given surface potential cannot be obtained. Further, since laser beams reflect at random on a surface of the conductive base body 21 and hence, there also exists a possibility that moiré fringes are generated on a half pattern. Accordingly, it is preferable to set the film thickness of the photosensitive body drum 11 to a value which falls within a range of 10 to 30 μm by taking the charging ability, the dielectric strength, the dark decay characteristics, the manufacturing cost and the quality into consideration.

Further, as a more preferred mode of the photosensitive body drum 11, it is desirable that the thickness of the surface protective layer 18 is set to a value equal to or less than 20,000 angstrom, and is set preferably to a value which falls within a range of 5000 to 15,000 angstrom. When the thickness of the surface protective layer 18 becomes less than 5000 angstrom, the dielectric strength against the inflow of a negative current from a transfer roll 15 which has a polarity opposite to the charged polarity is lowered and hence, there exists a possibility that the surface protective layer 18 is deteriorated at an early stage before printing 15,000 sheets of paper. On the other hand, when the thickness of the surface protective layer 18 exceeds 20,000 angstrom, a film forming time is prolonged and hence, it is disadvantageous in view of a cost. Accordingly, it is preferable to set the thickness of the surface protective layer 18 to a value which falls within a range of 5,000 to 15,000 angstrom by keeping a balance among the charging ability, the wear resistance, the environment resistance property and the film forming time.

(3)-2 Material and Hardness

Although the material (photosensitive layer material) which forms the photosensitive layer 19 is not particularly limited, in the present invention, it is preferable to use an amorphous silicon (a-Si) photosensitive body and it is also preferable that the Vickers hardness of an outermost surface of the amorphous silicon photosensitive body is set to 300 or less.

Due to such formation of the photosensitive layer 19, it is possible to effectively obtain a polishing effect of a surface of the photosensitive body attributed to the above-mentioned additive agent and hence, it is possible to maintain the stable image property for a long period.

Further, as other suitable materials, an inorganic material such as a-SiC, a-SiO, a-SiON and the like may be named. Among these materials, it is preferable to use the a-SiC which particularly exhibits the high resistance, the higher charging ability, the higher wear resistance and the high environment resistance property.

Further, when the a-SiC is used as the photosensitive body material, it is preferable to use the a-SiC in which a rate between Si and C falls within a given range. The a-SiC may be an a-$Si_{1-X}C_X$ (value of X being less than 0.3 to less than 1) and may preferably be an a-$Si_{1-X}C_X$ (value of X being less than 0.5 to less than 0.95). When the a-SiC having the ratio between Si and C within such ranges exhibits the high resistance when $1\times10^{12}$ to $1\times10^{13}$ Ωcm and hence, the flow of the latent image charge on the surface of the photosensitive body in the direction of the photosensitive body in the present invention is small whereby a-SiC also exhibits the excellent property in the maintenance of the electrostatic latent image and the excellent moisture resistance.

Here, the photosensitive body drum in the present invention is not particularly limited to the a-Si photosensitive body drum and various organic photosensitive body (OPC) drum may be used in place of the above-mentioned a-Si photosensitive body drum 11.

(3)-3 Surface Potential

The surface potential (charging potential) of the photosensitive body drum 11 may be set to a value which falls within a range of +200 to +500V and preferably to a value which falls within a range of +200 to +300V. The reason is that when the surface potential assumes the value less than +200, the developing electric field becomes insufficient and hence, it is difficult to ensure the image density.

On the other hand, when the surface potential exceeds +500, there arise drawbacks such that the charging ability may become insufficient depending on the film thickness of the photosensitive body drum 11 or black points which are generated when the insulation breakdown occurs on the photosensitive body are liable to be generated on an image, and an ozone generation quantity is increased. Particularly, when the film thickness of the photosensitive body 11 is reduced, the charging ability of the photosensitive body drum 11 is liable to be lowered corresponding to the reduction of the film thickness.

Accordingly, it is preferable to set the surface potential of the surface of the photosensitive body drum 11 to the value which falls within the above-mentioned range from a viewpoint of keeping a balance among the developing property and the charging ability of the photosensitive body.

(4) Manufacturing Method

Next, the manufacturing method of the toner according to the present invention is explained.

First of all, in addition to the above-mentioned binding resin and magnetic powder, when necessary, the waxes, the coloring agent, the charge controlling agent, the additive agents are premixed using a known method and, thereafter, are melted and kneaded to prepare the resin composition for toner.

Here, it is preferable to perform the premixing treatment using, for example, a Henschel mixer, a ball mill, a super mixer, a dry blender or the like, while it is preferable to perform the melting and kneading treatment using a twin-screw extruder, one-screw extruder or the like.

Next, the obtained resin composition for toner is pulverized using a known method and, thereafter, and fine-power classifying is performed to produce the toner particles.

Here, it is preferable to perform the pulverizing treatment using an airflow type pulverizer, for example, while it is preferable to perform the classifying treatment by using an air classifying machine or the like, for example.

The toner which is obtained in this manner is mixed with the additive agents in a known method thus forming the toner which contains the additive agents. As a method for adding the additive agents, the additive agents are mixed with the toner using a Henschel mixer.

Second Embodiment

The second embodiment is directed to an image forming method to which the magnetic mono-component toner used in a jumping developing method which develops an electrostatic latent image formed on a latent image carrier using a developer carrier. The image forming method is characterized by using a toner which includes toner particles which contain at least a binding resin and a magnetic powder, and the coarse powder distribution (S) of the toner particles satisfies the above-mentioned formula (1).

Hereinafter, the content which is explained in the first embodiment is omitted and the second embodiment is explained by focusing on the constitution of the image forming device which uses the above-mentioned magnetic mono-component toner and the image forming method.

(1) Image Forming Device (1)-1 Basic Constitution

Figure 6:
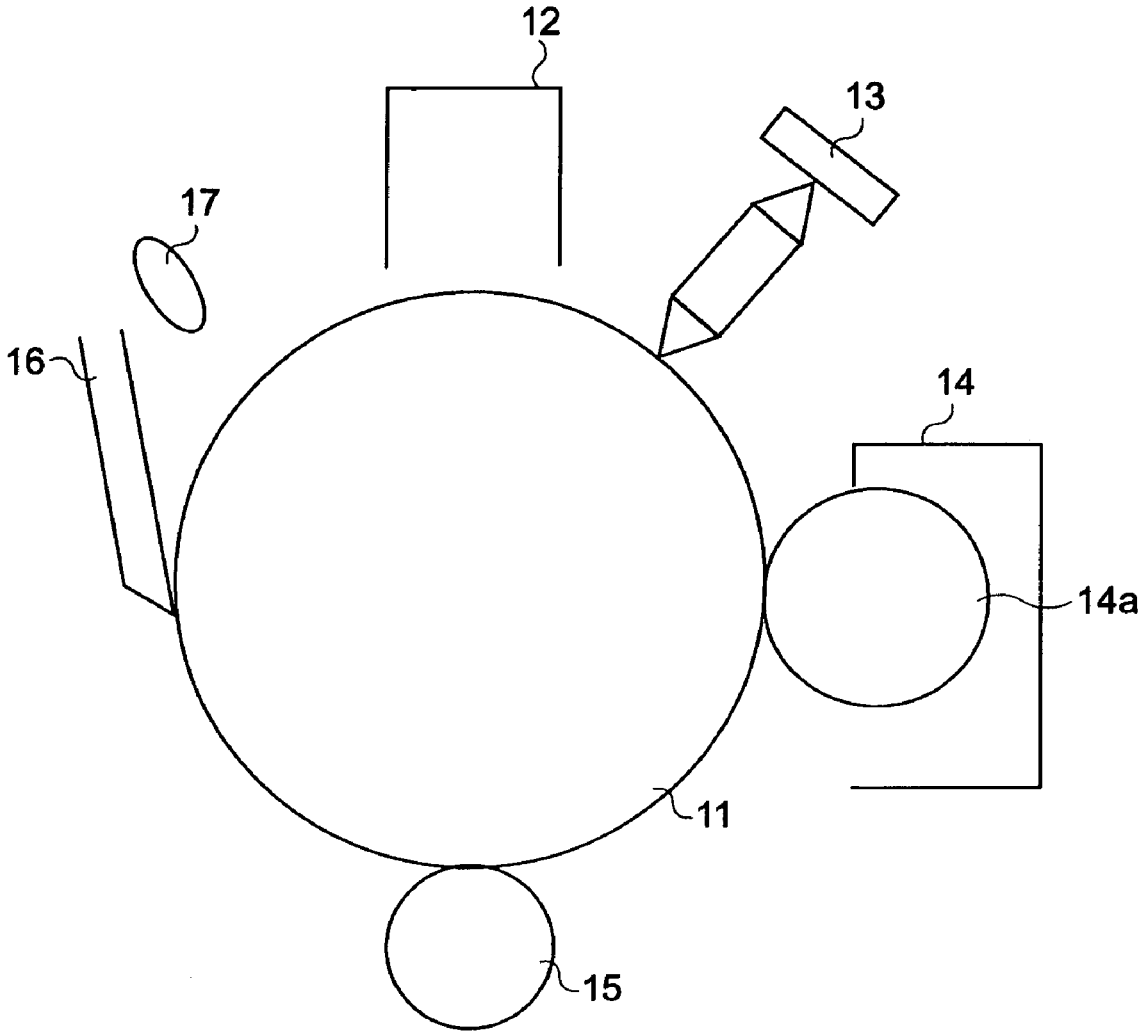
FIG. 6 is a schematic view showing one example of an image forming device according to the present invention.

In exercising the image forming method of the second embodiment, it is possible to preferably use the an image forming device shown in FIG. 6.

The image forming device includes a developing system based on a magnetic mono-component jumping developing method and uses a photosensitive body drum 11 as the latent image carrier. Around the photosensitive body drum 11, a scorotron charger 12, an exposing unit 13, a developing unit 14, a transfer roll 15, a cleaning blade (cleaning means) 16 an a charge eliminating lamp (erasing means) 17 are arranged.

In the image forming device, the photosensitive body drum 11 is charged using the scorotron charger 12, the exposure is made in response to photo signals which are obtained by conversion based on the printed data thus forming an electrostatic image on the photosensitive body drum 11. On the other hand, in the developer 14, along with the rotation of a developing sleeve 14*a* (developer carrier) which is arranged to face the photosensitive body drum 11 and incorporates a fixed magnetic roller (not shown in the drawing) therein, the toner is conveyed, and by allowing the toner to pass through between a magnetic blade (not shown in the drawing) and the developing sleeve 14*a*, a toner thin layer is formed on a surface of the developing sleeve 14*a*. Then, the toner is supplied onto the photosensitive body drum 11 from the toner thin layer, and an electrostatic latent image which is formed on the photosensitive body drum 11 is developed.

The developed toner image is transferred to a transferring material (such as a printing paper) using a transfer roller 15. On the other hand, the toner (waste toner) which remains on the surface of the photosensitive body drum 11 without being transferred to the transferring material is removed by a cleaning blade 16. The waste toner temporarily stays in the vicinity of a distal end of the cleaning blade 16 and is gradually pushed forward by the succeeding waste toner and moved to a transport member side such as a screw roller not shown in the drawings and is transported to a waste toner vessel (not shown in the drawing). A residual charge on the surface of the photosensitive body drum 11 from which the waste toner is removed is removed by the charge eliminating lamp 17.

(1)-2 Developing Sleeve

It is desirable that a ten-point average roughness Rz of the surface of the developing sleeve 14*a* is set to a value which falls within a range of 2.0 to 8.0 cm. The reason is that when the ten-point average roughness Rz becomes less than 2.0%, there exists a possibility that a toner transport force is lowered and hence, the image density is lowered and, further, a toner layer above the developing sleeve 14*a* is disturbed thus deteriorating the image quality, while when ten-point average roughness Rz exceeds 8.0 μm, the toner transport quantity is increased, a layer disturbance is generated, the image quality is worsened, and leaking of the toner from projecting portions on a surface of the surface of the sleeve 14*a* to the photosensitive body drum 11 is generated thus forming black points in the image thus spoiling the image quality. The ten-point average roughness Rz may be measured using a surface roughness measuring equipment "Surf coder SE-30D" made by Kosaka Laboratory Ltd., for example.

As a material for forming the developing sleeve 14*a*, for example, aluminum, stainless steel (SUS) or the like may be used. To take the high durability into consideration, it is preferable to use SUS as the sleeve material. For example, it is possible to use SUS303, SUS304, SUS305, SUS316 or the like. Particularly, it is further desirable to use SUS 305 which contains the weak magnetism and is liable to be easily formed.

(1)-3 Charger

The scorotron charger 12 is constituted of a shield case, a corona wire, a grid and the like, wherein it is preferable to set a distance between the corona wire and the grid to a value which falls within a range of 5.3 to 6.3 mm. Further, it is preferable to set a distance between the grid and the photosensitive body drum 11 to a value which falls within a range of 0.4 to 0.8 mm. When the distance is less than 0.4 mm, there exists a possibility that a spark discharge is generated, while when the distance exceeds 0.8 mm, there arises a drawback that the charging ability is lowered.

(1)-4 Transfer Roller

The transfer roller 15 is brought into contact with the photosensitive body drum 11 and it is desirable that the transfer roller 15 is, upon receiving a driving force, rotated relative to the photosensitive body drum 11 by a line speed difference of 3 to 5%. When the line speed difference becomes less than 3%, the transfer ability is decreased and hence, there arises a possibility that a portion of the toner image is not transferred, while when the line speed difference exceeds 5%, the slip between the transfer roller 15 and the photosensitive body drum 11 is increased and hence, there exists a possibility that the jitter is increased.

As a material used for forming the transfer roller 15, it is preferable to use a foamed EPDM (ethylene-propylene-diene ternary polymer). With the use of such a foamed body, the toner which is contaminated during paper clogging or the like enters bubbles of a foam and hence, it is possible to prevent a back surface of the first paper after resuming the operation from being smeared with the toner. Further, with the use of foam-based material, it is unnecessary to clean the transfer roller 15 and hence, it is possible to reduce a cost. The rubber hardness of the transfer roller 15 is 35°±50° (asker C: Standard of the Society of Rubber Industry, Japan "SRIS-0101C type").

When the rubber hardness is less than 30°, the defective transfer arises, while when the rubber hardness exceeds 40°, a nip between the transfer roller 15 and the photosensitive body drum 11 becomes small and hence, a transfer force is lowered.

(1)-5 Cleaning Blade

In this embodiment, as the cleaning means of the surface of the photosensitive body drum 11, the cleaning blade 16 is used. The cleaning blade 16 is arranged at the downstream side in the rotational direction of the photosensitive body drum 11 than the transfer roller 15 and brings a distal end thereof into contact with the photosensitive body drum 11. Due to such a constitution, it is possible to remove the waste toner which remains on the surface of the photosensitive body drum 11 without being transferred to the transferring member.

The cleaning blade 16 is preferably formed of a resilient blade having resiliency. Due to such a constitution, it is possible to prevent the surface of the photosensitive body drum 11 from being damaged by the cleaning blade 16. As the resilient material, for example, urethane rubber, silicone rubber, a resin possessing resiliency and the like are named. The cleaning blade 16 is obtained by forming the resilient material into a blade shape or by mounting a resilient member on a distal end of the blade made of metal or the like.

(1)-6 Latent Image Carrier

The latent image carrier used in the second embodiment may have the substantially equal constitution as the latent image carrier explained in conjunction with the first embodiment.

(2) Magnetic Mono-Component Toner for Developing Electrostatic Latent Image

The toner for developing electrostatic latent image used in the second embodiment is a magnetic mono-component toner used in a jumping developing method in which the latent image formed on the latent image carrier is developed by the developer carrier, wherein the toner includes toner particles which contain at least a binding resin and a magnetic powder, and the coarse powder distribution (S) of the toner particles satisfies a following formula (1), Here, the detail of the toner is substantially equal to the toner having the content explained in the embodiment 1.

EXAMPLE

Hereinafter, the present invention is further explained in detail in conjunction with the examples. It is needless to say that the explanation made hereinafter illustrates the present invention and the scope of the present invention is not limited to the following explanation.

Example 1

(1) Production of Toner Particles

Firstly, 50 parts by weight of the binding resin, 43 parts by weight of magnetic powder, 3 parts by weight of release agent and 4 parts by weight of positive charge controlling agent are mixed by a Henschel mixer and are melted and kneaded by a twin-screw extruder and thereafter cooled and are coarsely ground by a hammer mill. This coarsely ground material is further finely pulverized by a mechanical grinder and then is classified by changing the angle of the classified zone of the classified point for the coarse powder and the fine powder using an air classifier, "Elbow-Jet Classifying Machine EJ-LABO Type made by Nittetsu Mining Co. Ltd." to obtain magnetic toner particle.

Next, 1 part by weight of silica ([RA-200H] made by Nippon Aerosil Co. Ltd.) and 1.4 parts by weight of titanium oxide [ST-100] made by Titan Kogyo KK as additive agents are added to 100 parts by weight of the obtained magnetic toner particle and are mixed under agitation so that these additive agents are adhered to the surface of the magnetic toner particle to prepare a magnetic one-component toner shown in the Table 1.

Also, as the binding resin, styrene/acrylic copolymer which exhibits a molecular weight (Mw) of 47,000, molecular weight peaks of 5,000 and 931,000, 5% of a THF insoluble content, 29.0 of molecular weight distribution (Mw/Mn) and a glass transition point (Tg) of 58° C. is used. As the magnetic powder, octahedral magnetic particles which exhibit a coercive force of 5.0 kA/m of, the saturation magnetization of 82 $Am^2/kg$, the residual magnetization of 11 $Am^2/kg$ of and a number average particle size of 0.22 μm when a coercive force of 796 kA/m is applied is used. As a release agent, a wax (Sasol Wax Hi made by Sasol Co. Ltd.) is used. Further, as a positive charge controlling agent, a quaternary ammonium salt such as Bontron B-51 (made by Orient Chemical Corp) is used.

(2) A Measuring Method for Particle Distribution

Further, the particle size distribution is measured using a particle size measuring device "Coulter Counter-TA-II type" made by Coulter Counter Corp, wherein the measurement is performed using an aperture diameter of 100 μm. To be more specific, an interface and a personal computer which output the volume average distribution and the number average distribution are connected.

Next, as an electrolytic solution, 1% sodium chloride aqueous solution is prepared using sodium chloride which is a primary reagent. As a dispersion agent, 0.1 to 5 ml of a surfactant ("Mypet" made by Kao Corp, main component: alkeybenzensulfonate) is added to the 100 to 150 ml of electrolytic solution. Further, 0.5 to 50 mg of toner which constitutes a measuring sample is added to the electrolytic solution and is suspended.

Next, the suspended electrolytic solution is subjected to the dispersion treatment for approximately 1 to 3 minutes using an ultrasonic disperser and, thereafter, using the particle size measuring device "Coulter Counter-TA-II type which has an aperture diameter of 100 μm, the particle size distribution of the toner is measured and the volume distribution and the number distribution are obtained.

Finally, based on the volume distribution and the number distribution, the volume average particle size ($D_{50}$) of the toner, the volume % of the coarse powder having a size larger than $D_{50}$ by 2 μm or more, and the number % of coarse powder having the particle size equal to or less than 4.0 μm are obtained. The obtained result is shown in Table 1.

(3) Measuring Method of Average Circularity

Further, in measuring the average circularity of a group of particles having a size corresponding to a circle larger than 2 μm, a flow type particle image analyzer ("FPIA-1000 type" made by Sysmex Corp) is used to measure the average circularity.

(4) Image Property and Durability

Further, with respect to the image property and the durability, the obtained magnetic mono-component toner is set in a page printer "FS-9500DN" (printing speed: 50 sheets/min, "A3 size", line speed: 230 mm/sec) made by Kyocera Mita Corp on which an amorphous silicon photosensitive body is mounted, and following evaluation items are evaluated. Here, as the material of the developing sleeve, SUS305 (ten-point average roughness Rz: 5.2 μm) is used.

(5) Evaluations (5)-1 Solid Image Density

Under a normal temperature and normal humidity environment (20° C., 65% RH), an image obtained by printing an image evaluation pattern at an initial stage is set as an initial image. Thereafter, the printing is continuously performed and, the image evaluation pattern is again printed after 150,000 sheets are printed and after 300,000 sheets are printed and is used as the post durable image.

Next, the obtained solid image is measured using a Macbeth reflection density meter (RD914) and the density measurement is performed on nine portions of a matted portion. Average values (ID) are evaluated as a solid image density in accordance with following criteria and obtained results are shown in Table 2.

Good (G): The value of solid image density is equal to or more than 1.30.

Fair (F): The value of solid image density is equal to or more than 1.20 and less than 1.30.

Bad (B): The value of solid image density is less than 1.20.

(5)-2 Uniformity of Image Density

Further, with respect to the uniformity of the image density, the uniformity of density of image evaluation patterns obtained in the solid image density evaluation is observed with naked eyes and the evaluation is made in accordance with following criteria. Obtained results are shown in Table 2.

Good (G): No density irregularities are observed in a whole region.

Fair (F): Although the density irregularities are partially observed, there is no problem practically.

Bad (B): Density irregularities are observed in a whole region.

(5)-3 Evaluation of Background Fogging

Further, the fogging (overlapping) of the images of the image evaluation pattern obtained by the solid image density evaluation is observed with naked eyes and is evaluated in accordance with following criteria. The obtained result is shown in Table 2.

Good (G): No fogging is observed in a whole region.

Fair (F): Although the fogging is partially observed, there is no problem practically.

Bad (B): Fogging is observed in a whole region.

(5)-4 Evaluation of Particle Size Distribution

Further, in the evaluation of the solid image density, the toner particle size distribution [the volume average particle size ($D_{50}$), the volume % of the coarse powder having a size larger than $D_{50}$ by 2 μm] in the inside of the developing unit of the above-mentioned page printer is measured at the initial stage, after 150,000 sheets are made to pass, and after 300,000 sheets are made to pass. The obtained result is shown in Table 3.

(5)-5 Evaluation of Developing Sleeve

The relationship between the ten-point average roughness (Rz) of the surface of the developing sleeve and the uniformity of the image density is evaluated in accordance with following criteria by observing the uniformity of density of the image evaluation pattern obtained by the solid image density evaluation with naked eyes. The obtained result is shown in Table 4.

Good (G): No density irregularities are observed in a whole region.

Fair (F): Although the density irregularities are partially observed, there is no problem practically.

Bad (B): The density irregularities are observed in a whole region.

Examples 2 to 6

Comparison Examples 1 to 3

In the same manner as the embodiment 1, the magnetic 1-component toners respectively having the particle size distributions and the average circularities shown in Table 1 are obtained. Obtained results are shown in Table 1. Also with respect to these toners, the evaluation of the respective properties is performed in the same manner as the embodiment 1. The obtained results are shown in Table 2 and Table 3.

TABLE 1

| | Coarse powder distribution (Volume %/μm) | $D_{50}$ of the based on volume (μm) | Coarse powder having particle size larger than $D_{50}$ by 2 μm or more (Volume %) | Fine powder having particle size of 4 μm or less (Number %) | Average circularity (-) |
|---|---|---|---|---|---|
| Example 1 | 20.7 | 5.1 | 8.7 | 26.8 | 0.94 |
| Example 2 | 19.9 | 7.9 | 10.2 | 15.2 | 0.95 |
| Example 3 | 18.6 | 9.6 | 12.8 | 10.4 | 0.93 |
| Example 4 | 19.4 | 8.2 | 11.3 | 18.2 | 0.94 |
| Example 5 | 18.9 | 7.6 | 12.2 | 19 | 0.94 |
| Example 6 | 17.7 | 7.8 | 14.6 | 8.6 | 0.93 |
| Comparison Example 1 | 16.6 | 8 | 16.8 | 8.8 | 0.93 |
| Comparison Example 2 | 15.9 | 7.6 | 18.2 | 18.3 | 0.94 |
| Comparison Example 3 | 16.5 | 7.9 | 17 | 8.4 | 0.97 |

TABLE 2

| | Solid Image Density | | | | | | Uniformity of Image Density | | | Background Fogging | | |
|---|---|---|---|---|---|---|---|---|---|---|---|---|
| | Initial Stage(1) | | After 150,000 Print(2) | | After 300,000 Print(3) | | Initial Stage(1) | After 150,000 Print(2) | After 300,000 Print(3) | Initial Stage(1) | After 150,000 Print(2) | After 300,000 Print(3) |
| Example 1 | 1.34 | G | 1.33 | G | 1.32 | G | G | G | G | G | G | G |
| Example 2 | 1.42 | G | 1.40 | G | 1.37 | G | G | G | G | G | G | G |
| Example 3 | 1.43 | G | 1.40 | G | 1.41 | G | G | G | G | G | G | G |
| Example 4 | 1.40 | G | 1.37 | G | 1.43 | G | G | G | G | G | G | G |
| Example 5 | 1.39 | G | 1.38 | G | 1.36 | G | G | G | G | G | G | G |
| Example 6 | 1.40 | G | 1.35 | G | 1.40 | G | G | G | G | G | G | G |
| Comparison Example 1 | 1.38 | G | 1.15 | B | —(4) | | G | F | —(4) | G | F | —(4) |
| Comparison Example 2 | 1.42 | G | 1.06 | B | —(4) | | G | F | —(4) | G | B | —(4) |
| Comparison Example 3 | 1.40 | G | 1.17 | B | —(4) | | G | F | —(4) | G | F | —(4) |

(1)Initial Stage: evaluate based on image immediately after installation of toner.
(2)After 150,000 Prints: evaluate based on image after continuously printing 150,000 sheets of ISO 4% original.
(3)After 300,000 Prints: evaluate based on image after continuously printing 300,000 sheets of ISO 4% original.
(4)—: evaluation stopped since the image density is lowered.

TABLE 3

| | $D_{50}$ of the basis of volume (μm) | | | Coarse powder having particle size larger than $D_{50}$ by 2 μm or more (Volume %) | | |
|---|---|---|---|---|---|---|
| | Initial Stage(1) | After 150,000 Prints(2) | After 300,000 Prints(3) | Initial Stage(1) | After 150,000 Prints(2) | After 300,000 Prints(3) |
| Example 1 | 5.1 | 5.8 | 5.8 | 8.7 | 9.6 | 9.8 |
| Example 2 | 7.9 | 8.2 | 8.3 | 10.2 | 12.2 | 11.9 |
| Example 3 | 9.6 | 10.2 | 10.1 | 12.8 | 13.3 | 13.6 |
| Example 4 | 8.2 | 8.5 | 8.6 | 11.3 | 12.6 | 12.8 |
| Example 5 | 7.6 | 9 | 8.7 | 12.2 | 19.3 | 19.8 |
| Example 6 | 7.8 | 8.2 | 8.3 | 14.6 | 22 | 22.6 |
| Comparison Example 1 | 8 | 9.7 | —(4) | 16.3 | 30.4 | —(4) |
| Comparison Example 2 | 7.6 | 10.4 | —(4) | 18.2 | 36.8 | —(4) |
| Comparison Example 3 | 7.9 | 9.6 | —(4) | 16.8 | 30.2 | —(4) |

(1)Initial Stage: evaluate based on image immediately after installation of toner.
(2)After 150,000 Prints: evaluate based on image after continuously printing 150,000 sheets of ISO 4% original.
(3)After 300,000 Prints: evaluate based on image after continuously printing 300,000 sheets of ISO 4% original.
(4)—: evaluation stopped since image density is lowered.

TABLE 4

| | Surface | Uniformity of Image Density | | |
|---|---|---|---|---|
| | Roughness (μm) | Initial Stage(1) | After 150,000 Prints(2) | After 300,000 Prints(3) |
| Example 1 | 5.2 | G | G | G |
| Example 7 | 2.5 | G | G | G |
| Example 8 | 4.5 | G | G | G |
| Example 9 | 7.8 | G | G | G |
| Example 10 | 1.5 | G | G | F |
| Example 11 | 8.8 | G | G | F |

(1)Initial Stage: evaluate based on image immediately after installation of toner.
(2)After 150,000 Prints: evaluate based on image after continuously printing 150,000 sheets of ISO 4% original.
(3)After 300,000 Prints: evaluate based on image after continuously printing 300,000 sheets of ISO 4% original.

Examples 7 to 11

With respect to the embodiments 7 to 11, as shown in Table 4, except for that the ten-point average roughness (Rz) on the developing sleeve is changed, the toner particles are prepared and evaluated in the same manner as the embodiment 1. Obtained results are shown in Table 4.

From the results shown in Table 2 and Table 3, the embodiments 1 to 6 have no drawbacks with respect to the image density, the uniformity of the image density and the background fogging and hence, the printing exhibits the high resolution and the favorable fine line reproducibility and hence can achieve the high-quality printing.

It is considered that such advantages are obtained due to the stable formation of the toner thin layer on the sleeve for a long period in addition to the prevention of the adverse influence to the photosensitive body drum. Further, irrelevant to the quantity of fine powdery material having the particle size of less than 4.0 μm, the evaluation result on the durability is favorable.

As a result, it is understood that the coarse powder distribution and the maintenance of the image density have the close relationship with each other. Further, in view of the evaluation of durability, although the coarse powder is slightly increased, it is understood that the influence that the degree of increase of the coarse powder gives to the obtained image is small. To the contrary, in the comparison examples 1 to 3, the charging property of the toner on the sleeve is liable to become defective and hence, the thickness of the toner thin layer is gradually decreased. As a result of a long-term experiment, the irregularities of the image appears and, at the same time, the heavy fogging appears and hence, the coarse powder distribution deviates from the developing proper region and hence, the image density cannot maintain the high density for a long period and hence, the evaluation of durability is interrupted. The worsening of the level of fogging along with the evaluation of the durability is one of the reason that the evaluation of durability is interrupted.

Further, irrespective of the quantity of the fine powder having the particle size of 4.0 μm or less, it is understood that the evaluation result of durability is low. Further, the accumulation of coarse powder in the developing unit is apparent and it is understood that this gives the adverse effect to the physical properties. Here, the results of the comparison example 1 and the comparison example 3 which differ in the average circularity exhibit the substantially same content and no influence attributed to the circularity is observed.

What is claimed is:

1. An image forming method using a mono-component toner, the image forming method comprising:

a photosensitive body drum formed an electrostatic latent image and a developing unit with a developing sleeve, the toner is supplied by a jumping developing method from a toner thin layer formed on the surface of the developing sleeve to the electrostatic latent image on the surface of the photosensitive body drum in order to form a toner image, wherein ten-point average surface roughness (Rz) of the surface on the developing sleeve is from 2 to 8 μm and the coarse powder distribution (S) of the toner particles satisfies a following formula (1), $$\text{coarse powder distribution } (S)=(50-A)/2 \geqq 17(\text{volume } \%/\mu\text{m}) \quad (1)$$

(wherein A: volume % of coarse powdery material having particle size larger Than $D_{50}$ based on volume by 2 μm or more).

2. The image forming method according to claim 1 comprising:

a transfer roller and a photosensitive body drum, and the transfer roller is brought into contact with the photosensitive body drum, and the transfer roller receives a driving force and is rotated relative to the photosensitive body drum by a line speed difference of 3 to 5%.

3. The image forming method according to claim 1, wherein a rubber hardness of the transfer roller is 35°±50°.

4. An image forming device comprising:

a photosensitive body drum for forming an electrostatic latent image and a developing unit with a developing sleeve, toner supplied by a jumping developing method from a toner thin layer formed on the surface of the developing sleeve to the electrostatic latent image on the surface of the photosensitive body drum in order to form a toner image, wherein ten-point average surface roughness (Rz) of the surface on the developing sleeve is from 2 to 8 μm, and the coarse powder distribution (S) of the toner particles satisfies a following formula (1), $$\text{coarse powder distribution } (S)=(50-A)/2 \geqq 17(\text{volume } \%/\mu\text{m}) \quad (1)$$

(wherein A: volume % of coarse powdery material having particle size larger than $D_{50}$ based on volume by 2 μm or more).

5. The image forming device according to claim 4 comprising a transfer roller and a photosensitive body drum, wherein the transfer roller is brought into contact with the photosensitive body drum, and the transfer roller receives a driving force and is rotated relative to the photosensitive body drum by a line speed difference of 3 to 5%.

6. The image forming device according to claim 4, wherein a rubber hardness of the transfer roller is 35°±5°.

* * * * *